United States Patent [19]

Neglio

[11] Patent Number: 4,759,462

[45] Date of Patent: Jul. 26, 1988

[54] CLOSURE FOR A THREADED OPENING

[76] Inventor: Thomas P. Neglio, 63 Cathedral Ave., Florham Park, N.J. 07932

[21] Appl. No.: 121,157

[22] Filed: Nov. 16, 1987

[51] Int. Cl.[4] ..... B65D 51/24

[52] U.S. Cl. ..... 220/235; 285/137.1; 285/196

[58] Field of Search ..... 285/196, 137.1; 210/459; 220/235, 236, 238, 234, 233; 215/359, 360, 309; 411/21, 22, 34, 37

[56] References Cited

U.S. PATENT DOCUMENTS

| | | | |
|---|---|---|---|
| 3,295,712 | 1/1967 | Peterson | 220/235 |
| 3,655,907 | 4/1972 | Philibert et al. | 138/89 X |
| 4,175,671 | 11/1979 | Holl et al. | 220/235 |

FOREIGN PATENT DOCUMENTS

| | | | |
|---|---|---|---|
| 569123 | 1/1959 | Canada | 215/309 |

*Primary Examiner*—Donald F. Norton

*Attorney, Agent, or Firm*—Warrick E. Lee, Jr.

[57] ABSTRACT

There is disclosed apparatus for closing a threaded opening in a container. A flexible plug capable of fitting within the threaded opening having a top and a bottom is provided. A flexible gasket larger than the opening is located at the top of the plug and a first rigid disk capable of fitting within the threaded opening is located at the bottom of the plug. A second rigid disk larger than the opening contacts the gasket. Means passing through the gasket and plug for causing the two disks to move toward each other compress the plug so that is firmly contacts the threads of the opening while the gasket is pressed against the opening by the second rigid disk. An excellent seal is thereby attained.

1 Claim, 1 Drawing Sheet

CLOSURE FOR A THREADED OPENING

BACKGROUND OF THE INVENTION

This invention comprises simple and inexpensive apparatus for closing a threaded opening in a container. The apparatus is particularly useful in conjunction with the filter described and claimed in my U.S. Pat. No. 4,626,347 (Dec. 2, 1986), the entire content of which is incorporated herein by reference. Briefly stated, U.S. Pat. No. 4,626,347 discloses filtration apparatus that attaches to an opening in a tank, especially an oil tank. A cable hangs from apparatus attached to an opening in the tank and a floating filter slides along the cable. The filter is connected to the outside of the tank by at least two partially flexible conduits that pass through the apparatus attached to the tank opening. The hole closure apparatus disclosed in my U.S. Pat. No. 4,626,347, while very effective, is constructed mostly of metal and has a relatively large thread that matches the threaded opening on the oil tank. The apparatus of the present invention is comprised mostly of flexible material, e.g. rubber, and requires, in the preferred embodiment, only one small thread. Hence the apparatus of the present invention is simpler and less expensive to produce.

A prior art closure for soft drink bottles having smooth necks uses a rubber plug, two disks abutting each end of the plug, and apparatus for causing the disks to move toward each other, thereby causing the rubber to expand and seal the smooth opening in the neck of the bottle. The present invention also uses two disks to compress a flexible plug. However, the resulting expansion of the flexible plug will not easily fill and seal the threads of the threaded opening. Fortunately the present invention overcomes this difficulty.

SUMMARY OF THE INVENTION

The present invention may be summarized as apparatus for closing a threaded opening in a container comprising (a) a flexible plug capable of fitting within the threaded opening having a top and a bottom, (b) a flexible gasket larger than the threaded opening located at the top of said plug, (c) a first rigid disk capable of fitting within the threaded opening located at the bottom on said plug, (d) a second rigid disk having first and second sides larger than the opening having its first side in contact with said gasket, and (e) means passing through said plug and gasket for causing said disks to move toward each other, thereby compressing said plug, said plug being of sufficient size to press against the threads of the threaded opening when said plug is compressed.

Preferred additional features of the invention are:

A. a single piece of flexible material to constitute the gasket and plug,

B. a bolt constituting the means for causing the disks to move toward each other, said bolt passing through the second disk, gasket, and plug, into a threaded opening in the first disk, and C. at least one conduit passing through the plug, gasket, first disk and second disk.

On course all possible combinations of the above features are also within the scope of the invention.

DETAILED DESCRIPTION OF THE INVENTION

Figure 1:
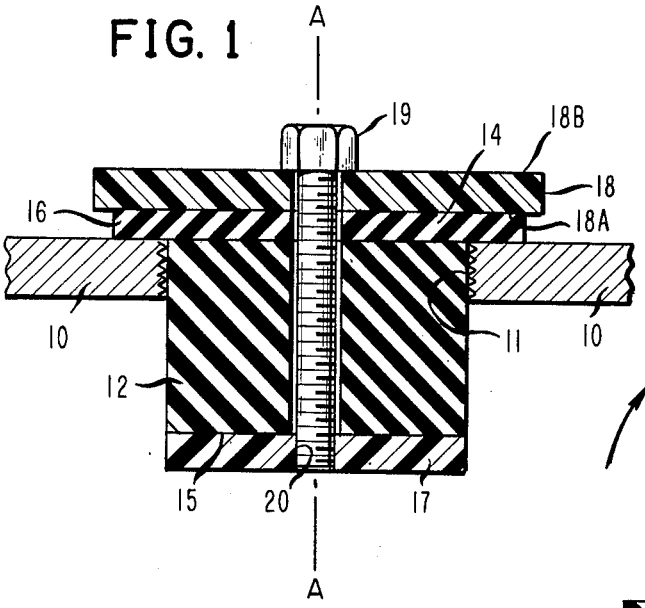
FIG. 1 is a sectional view of apparatus of the invention.

As shown in FIG. 1, wall 10 of a container has a threaded opening 11 to be closed by the inventive apparatus. The container may be any vessel capable of holding liquid or gas. However, the apparatus is especially suited for sealing the threaded opening in in a fuel oil tank. Such openings are typically about two inches in diameter, but the invention is not limited as to the size of the openings that it may close.

A flexible plug 12 capable of fitting within opening 11 is provided. Plug 12 has a top 14 and a bottom 15. The plug may be made of any flexible material, e.g. rubber, synthetic elastomer, etc. For fuel oil tanks, oil-resistant rubber, e.g. neoprene, is preferred. Flexible gasket 16, larger than opening 11, is located at the top 14 of plug 11. Like plug 12, the gasket may be constructed of any flexible material and is preferably the same material as plug 12.

First rigid disk 17, capable of fitting within opening 11 is located at bottom 15 of plug 12. Disk 17 may be constructed of any rigid material, but is preferably oil-resistant PVC. Of course metal may also be used. A plastic disk having a metal insert containing thread 20, described later, is most preferred. Second rigid disk 18, larger than opening 12 and having first side 18A and second side 18B is located with the first side 18B in contact with gasket 16. Second disk 18 is preferably constructed of PVC, but any other rigid material, e.g. metal, is operable.

Means are provided for causing the two disks to move toward each other. In FIG. 1 these means are a bolt 19 passing through unthreaded openings in second disk 18, gasket 16, and plug 12, and into a threaded hole 20 in first disk 17. When bolt 19 is tightened, disks 17 and 18 move toward each other, causing flexible plug 12 to expand radially against the threads of opening 11, thereby firmly locking the apparatus in place. Simultaneously disk 18 is forced downward, causing gasket 16 to firmly seal the opening. The downward force does not wrinkle gasket 16.

Except for the head of bolt 19 and container walls 10, all of the elements shown in FIG. 1 are normally circular. Hence, rotation of FIG. 1 about axis AA generates the apparatus in three dimensions.

If the threads of bolt 19 and threaded opening 20 do not provide a tight enough seal against each other, a small gasket, not shown, may be located between the head of bolt 19 and second side 18B of second disk 18. If bolt 19 is threaded only near its end that fits into threaded hole 20, flexible plug 12 will expand against the unthreaded portion of the bolt, thereby perfecting the seal.

Flexible plug 12 is large enough to press against the threads of opening 11 when compressed by disks 17 and 18. Preferably plug 12 is of sufficient size to barely fit into opening 11. Of course, a plug made of more flexible material may be smaller, since it will expand more radially when compressed longitudinally.

Figure 2:
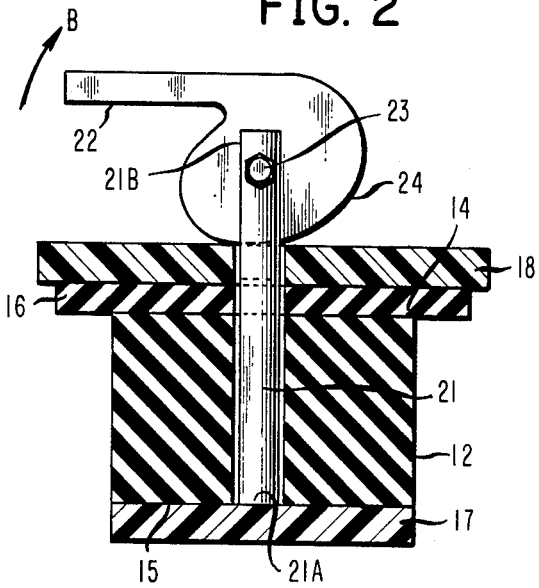
FIG. 2 is a view similar to FIG. 1 showing a different means for causing the two disks to move toward each other.

FIG. 2 shows an alternative means for causing the rigid disks to move towards each other. In all the figures like parts are identified by the same numeral and will not be redescribed. In FIG. 2 rod 21 passes through second disk 18, gasket 16 and plug 12. Bottom end 21A of rod 21 is attached to disk 17. Lever 22 is attached to cam 24 which, in turn, is rotatably attached to top end 21B of rod 21 by bolt 23. Rotating lever 22 in the direction of arrow B causes disks 17 and 18 to move toward each other. In general any means for causing the two disks to move toward each other may be used.

Figure 3:
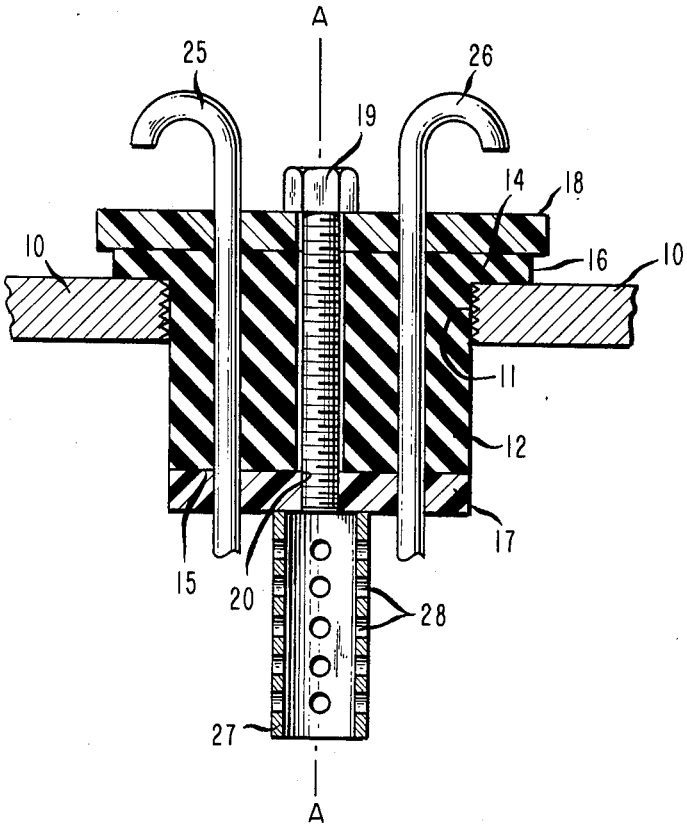
FIG. 3 is a view similar to FIG. 1 showing preferred additional features.

FIG. 3 shows the preferred embodiment of the invention for use with the filtration apparatus of U.S. Pat. No. 4,626,347. In FIG. 3, two conduits 25 and 26, e.g. copper tubing, pass through disk 18, gasket 16, plug 12, and disk 17. These conduits need not be rigidly attached to the disks, because the compression of flexible plug 12 causes the plug to firmly grip the conduits. The grip is so tight that material will not leak by the conduits after bolt 19 is tightened.

Another preferred feature illustrated in FIG. 3 is that gasket 16 and plug 12 are formed of a single piece of flexible material.

Yet another feature of FIG. 3 is means for attaching a flexible cable to disk 17. In FIG. 3, tube 27 having holes 28 is attached to disk 17. A flexible cable (not shown) used with the filtration apparatus of U.S. Pat. No. 4,626,374, may be conveniently attached to tube 27 through holes 28.

It can be seen that this invention provides several advantages:

1. A very tight seal is provided by very simple and inexpensive apparatus. The apparatus of the invention was installed in a 2⅜ inch threaded opening of a home heating oil tank. Air pressure was applied to the tank. No air leaked through the opening closed by the apparatus.

2. The gasket does not wrinkle, no matter how tightly the apparatus is installed.

3. Since the plug and disk of the inventive apparatus fit into the threaded opening to be closed, there is no need to have access to the interior of the container to close the opening.

What is claimed is:

1. Apparatus for closing a threaded opening in a container comprising:

(a) a flexible plug capable of fitting within the threaded opening having a top and a bottom, (b) a flexible gasket larger than the threaded opening located at the top of said plug, said gasket and plug constituting a single piece of flexible material, (c) a first rigid disk capable of fitting within the threaded opening located at the bottom of said plug, (d) a second rigid disk having first and second sides larger than the opening having its first side in contact with said gasket, and (e) means passing through said plug and gasket for causing said disks to move toward each other, thereby compressing said plug, said means being a bolt passing through said second disk, gasket, and plug, into a threaded hole in said first disk, said plug being of sufficient size to press against the threads of the threaded opening when said plug is compressed, said apparatus further comprising two conduits passing through said plug, gasket, first disk, and second disk; and means for attaching a flexible cable to said first disk.

* * * * *